United States Patent [19]

Oswald

[11] Patent Number: 5,060,326

[45] Date of Patent: Oct. 29, 1991

[54] BED WITH FLUIDICALLY SUPPORTED SLATS

[76] Inventor: Kurt Oswald, Hauptstrasse 22-26, 6701 Fussgönheim, Fed. Rep. of Germany

[21] Appl. No.: 391,510

[22] PCT Filed: Aug. 23, 1988

[86] PCT No.: PCT/EP88/00754

§ 371 Date: Jun. 26, 1989

§ 102(e) Date: Jun. 26, 1989

[87] PCT Pub. No.: WO89/01749

PCT Pub. Date: Mar. 9, 1989

[30] Foreign Application Priority Data

Aug. 26, 1987 [DE] Fed. Rep. of Germany ..... 3728408

[51] Int. Cl.[5] ..... A47C 23/00

[52] U.S. Cl. ..... 5/236.1; 5/241

[58] Field of Search ..... 5/236 R, 237-241, 5/244, 446, 447

[56] References Cited

U.S. PATENT DOCUMENTS

| | | | |
|---|---|---|---|
| 4,525,886 | 7/1985 | Savenije | 5/236 R X |
| 4,682,378 | 7/1987 | Savenije | 5/241 X |
| 4,799,276 | 1/1989 | Kadish | 5/446 |

FOREIGN PATENT DOCUMENTS

| | | | |
|---|---|---|---|
| 0038155 | 10/1981 | European Pat. Off. | 5/238 |
| 2407692 | 7/1979 | France | 5/236 R |

*Primary Examiner*—Michael F. Trettel

*Attorney, Agent, or Firm*—Herbert L. Lerner; Laurence A. Greenberg

[57] ABSTRACT

A bed comprises a box-like frame with longitudinal parts (12) connected to transverse parts and laths (14, 15), mounted on the longitudinal parts of the frame, on which a mattress can be laid. To improve the distribution of the weight of a human body, the laths (14, 15) are mounted on the longitudinal parts of the frame by means of piston/cylinder mechanisms (16) arranged at each end of the laths. The hydraulic or pneumatic chambers of the piston/cylinder mechanisms (16) are in mutual hydraulic or pneumatic communication.

10 Claims, 3 Drawing Sheets

BED WITH FLUIDICALLY SUPPORTED SLATS

Figure 1:
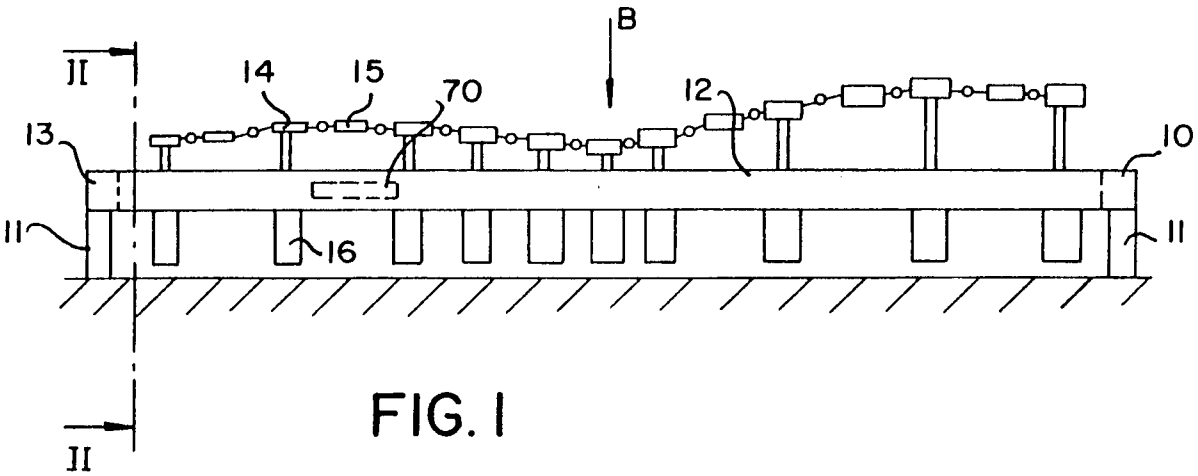

The invention relates to a bed, in particular a bed with a box-like frame having longitudinal frame parts and transverse frame parts joined to them and slats attached thereto, on which a mattress can optionally be placed.

Beds conventionally used to the present day normally have a bed frame, on the upper longitudinal frame parts of which are attached slats that have resilient properties and in general are made of especially glued wood. On the longitudinal frame parts, the slats are rotatably supported in pockets made of plastic and secured to the longitudinal frame parts, and as a result are to a certain extent capable of adapting to the weight of the person resting on them, by flexing slightly. Optionally, the slats may themselves be supported at their ends via their own spring elements on the longitudinal frame parts. Instead of the slats, springs can be attached to the frame, which permit resilient flexing.

This is not optimal, because beds with slats have the problem that a precise resiliency of the slats adapted to the body cannot be attained. In experiments, it has been found that the loads on the bed or on the individual slats varies, depending on which part of the body is observed. The buttocks, for instance, press more heavily on the slats than the upper torso, and the load on the slats from the legs is likewise considerably less than that in the area of the buttocks. The situation is similar with spring supports.

Accordingly, a rather thick mattress, either of foam rubber or one with box springs, must be laid on the slats in all of these kinds of beds, because only in this way is an at least somewhat even distribution of the weight of the human body possible, while avoiding pressure points on particular parts of the body. However, it would be advantageous to use a thin mattress, as much of possible of natural materials (natural fibers such as coconut fibers, horsehair, seaweed), for the sake of good ventilation from underneath, which is hardly possible with present conventional mattresses. Yet such relatively thin mattresses can hardly be used with present bed constructions.

The object of the invention is to improve a bed of the type described at the outset above in such a way that this variable load by the different parts of the human body is appropriately taken into account.

With the foregoing and other objects in view, there is provided, in accordance with the invention, a bed with a box-like frame having longitudinal frame parts and transverse frame parts joined to them and slats attached thereto, on which mattress can optionally be placed; at least some of the slats are supported on their ends in the vicinity of the longitudinal frame parts by means of a piston/cylinder mechanism on the longitudinal frame parts; and the hydraulically or pneumatically operative chambers in the piston/cylinder mechanisms communicate with one another hydraulically or pneumatically, so that the slats adjust to various heights in the vertical direction depending on the distribution of weight of a human body resting on them.

Because of the hydraulic connection of the hydraulically active chambers within the individual piston/cylinder mechanisms, an exact and precise adaptation of the location of the individual slats is attained in that by the compensation among the individual operative chambers of the piston/cylinder mechanism, an exact and precise adaptation to the contour of the human body is produced. That is, in contrast to springs, in which a spring characteristic is still considerable, the individual piston/cylinder mechanisms have an effect on one another, particularly since where the load due to the human body or body contour is the greatest, it is balanced by the load in the regions in which the weight on them is the least. Depending on the placement of the human body and on the position—whether supine or crosswise—a variable adjustment of the individual slats is obtained.

Because of this fine adaptation to the body contour, which is already highly advantageous per se because of the relief on the spinal column during sleep, the invention makes it possible to use a mattress of slight thickness, which need no longer be used merely to compensate in shape for the human body. Open-celled fiber materials can now be used, which are made of natural fibers and are virtually no more than 5 cm in thickness. This improves ventilation, and prevents excessive perspiration.

Particularly advantageously, the longitudinal frame parts embodied as hollow profiles can be used to effect hydraulic or pneumatic communication of the hydraulically or pneumatically operative chambers of the piston/cylinder mechanism.

Particularly advantageous features for guiding the fluid for the purpose of weight balancing are the following: Each of the piston/cylinder mechanisms has a guide sleeve extending through the longitudinal frame parts or the slats, in which sleeves the piston rod is guided longitudinally displacably and limitedly; the guide sleeve is surrounded by a support bushing that protrudes beyond the guide sleeve, and that the guide sleeve rests on the one hand against the lower surface of the longitudinal frame part or the slat and on the opposite end has a plug that is screwed to the guide sleeve and as a result presses the support bushing against the longitudinal frame part or the slat.

The opportunity exists of firmly defining the position of the individual slats. This is attained in accordance with the invention in that the piston/cylinder mechanisms are fixable in the adjusted position; in that for the fixation of the pistons of the piston/cylinder mechanisms, electromagnetically actuatable valves are provided in the supply line between the connection through the longitudinal frame parts and the operative chamber of the piston/cylinder mechanisms; in that an electromagnetic valve is secured to the outside face of the plug; and in that the chamber inside the longitudinal frame and/or slats communicates with the chamber beneath the piston or piston rod through the chamber inside the support bushing, the chamber between the electromagnetic valve and the plug via a through bore in the guide sleeve and bores in the plug, so that the fluid for the piston/cylinder mechanisms can flow from the longitudinal frame parts via the chamber between the guide sleeve and the support bushing through the closure plug, through to the electromagnetic valve, and from there through the central longitudinal bore to the operative chamber of the piston/cylinder mechanism, and in the reverse direction.

If the human body must rest on its back for a long time, for example when recovering from injuries to the spine, then the position of the individual slats to one another can be set once, and after that can be defined firmly by the closure of all the electromagnetic valves. This avoids uneven loads on individual parts of the body, a situation that for instance does exist if the body is placed on a flat board with a mattress in between.

For cost reasons, the piston/cylinder mechanism can be distributed as needed such that, for example, in the vicinity of the support of the buttocks, every slat or every other slat is supported by means of the piston/cylinder mechanism, while in contrast, of the slats that are located in the other regions, at most every other or every third one is supported by the piston/cylinder mechanism.

In accordance with a further feature of the invention air-filled hoses of elastic may be accomodated in the interior of the longitudinal frame parts of the bed frame, and these hoses can be compressed by increasing the pressure of the hydraulic fluid, thereby lowering the individual slats to a reduced extent. This may for instance be necessary to meet medical needs.

Buffers of elastic material are located between the individual cross bars, and in accordance with yet a further feature of invention the buffers together with the slats have a tension wire passing through them; by this provision, it is attained that the vertical spacing between two adjacent cross bars or slats does not become too great, and a continuous, steady curved contour of the slats is attainable.

The bed according to the invention may be embodied on the one hand as a health bed; on the other hand, it is an option to equip it as a massage bed, which in every respect can be used particularly advantageously in all fields of medicine.

According to the invention, this is attained in that the cross bars or slats are embodied as hollow cross bars, in which piston-cylinder mechanisms controlled by electromagnetically actuatable valves are provided, the piston tappets of which protrude upward out of the cross bars and can act upon a mat of elastic material placed on top of the piston tappets. The individual piston/cylinder mechanisms are embodied precisely like the piston/cylinder mechanisms in the longitudinal bars of the bed frame, and in the same manner they too have electromagnetic valves, by means of which the hydraulic fluid, preferably water, is supplied to the operative chamber of the piston/cylinder mechanisms; as a result, a massage effect is attainable in that the individual electromagnetic valves can be triggered by a suitable control means, optionally by an electronic program.

The invention will now be described in further detail along with further advantageous features and improvements and further advantages, in conjunction with the drawing, in which various exemplary embodiments of the invention are shown.

Figure 2:
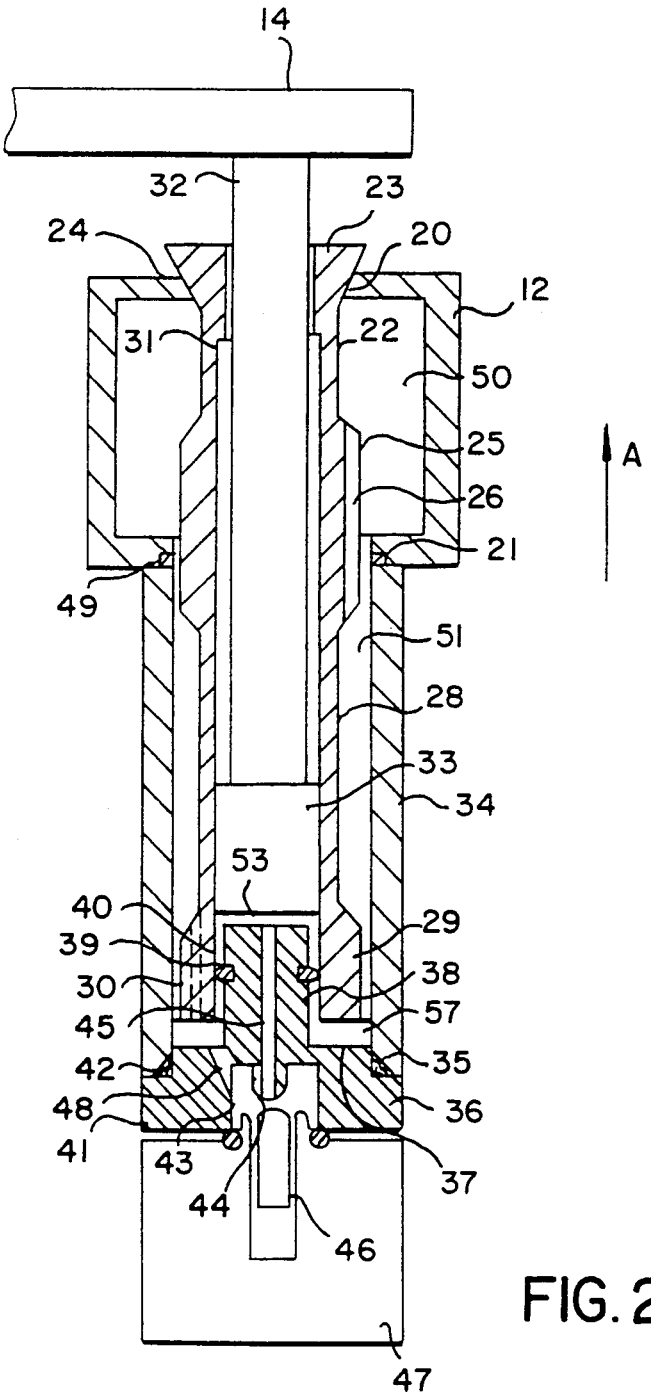

Shown are:

FIG. 1, side view on a bed according to the invention;

FIG. 2, a sectional view taken along the line II—II; and

Figure 4:
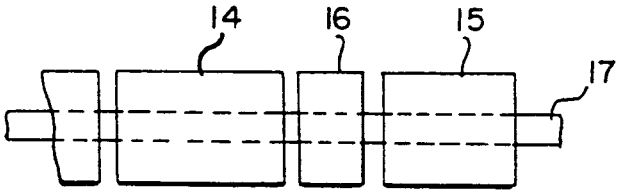
Figure 3:
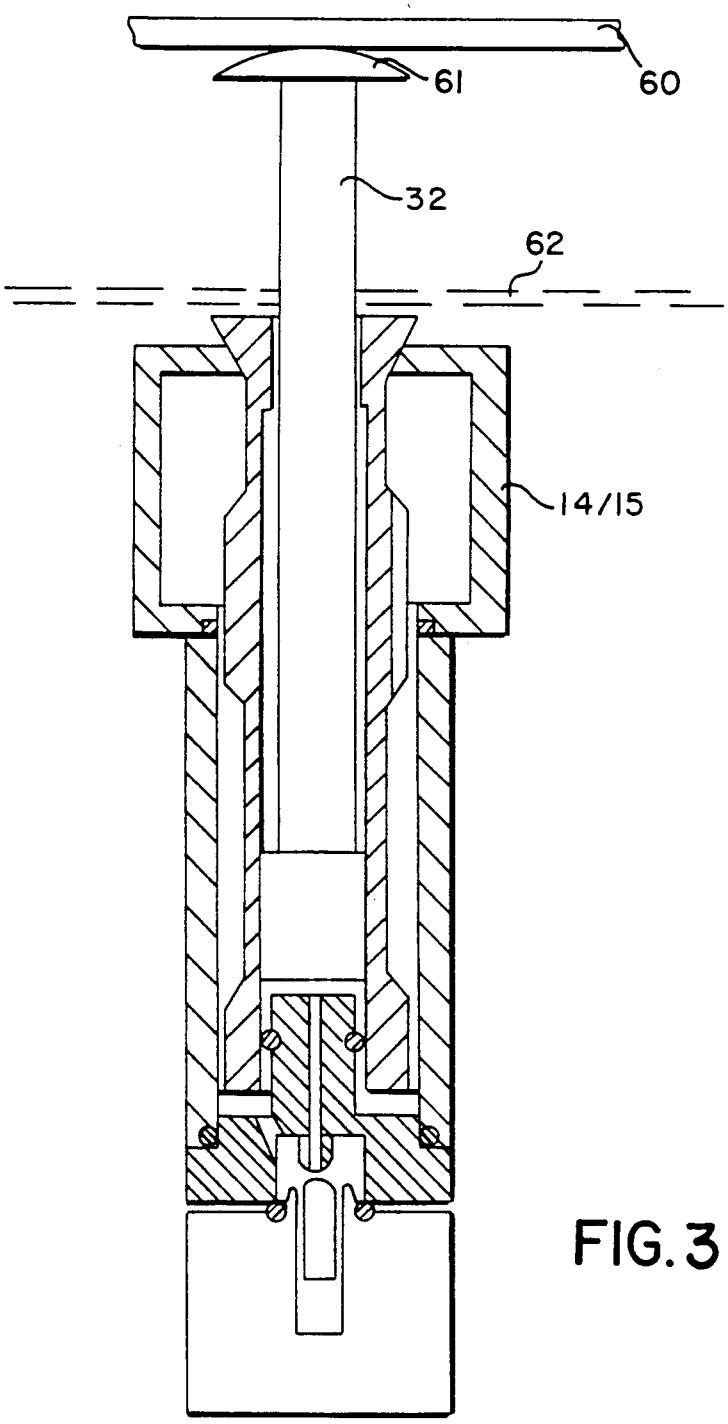

FIG. 3, a sectional view through a slat;

FIG. 4, an end view on two slats, and

Figure 5:
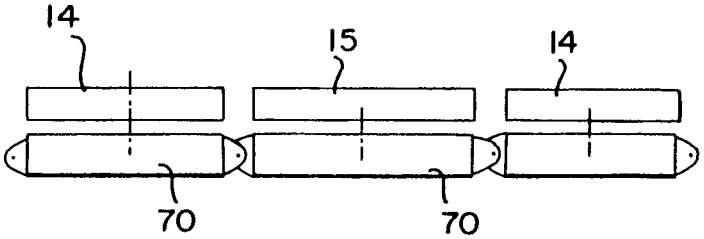

FIG. 5, a further embodiments of the slat guide.

The bed of FIG. 1 has a rectangular frame 10, which stands on the floor on four legs 11. The frame 10 has two longitudinal frame parts 12 and two transverse frame parts 13, the rear longitudinal frame part not being visible and the two transverse frame parts being merely suggested by dashed lines. The bed also has slats 14 and 15, of which the slats 14 are each supported on a hydraulic piston/cylinder mechanism 16, as shown in further detail in FIG. 2. As FIG. 4 shows, the individual slats 14 and 15 are braced against one another, with interposed plugs or spacer elements 71, by means of a tension wire 72; as a result, as shown in FIG. 1, not every slat needs to be secured to the hydraulic piston/-cylinder unit 16, but only every other slat. The slat 15, for instance, is not hydraulically supported. Instead of connecting the slats together as shown in FIGS. 1 and 4, a version with articulated rails 68 (FIG. 5) can also be used, with the individual slats secured to the joints of these rails.

FIG. 2 accordingly shows a piston/cylinder mechanism with which the individual slats 14 are supported. The longitudinal frame part 12 can be seen, which is a rectanglular or square hollow profile and has a bore 20 and 21 on its upper and lower wall, respectively. A guide sleeve 22 is guided through the bores 20 and 21, protruding on its upper end from the longitudinal frame part 12 and having a frustoconical enlargement 23, which is adapted to a frustoconical enlargement 24 of the bore 20. The bore 21 correspondingly also has a frustoconical enlargement. In each case these enlargements open toward the outside.

In the vicinity in which it passes through the bore 21, the guide sleeve 22 has a region 25 of increased diameter, and a longitudinal groove 26 is provided in this region. The region 27 above the region 25 and the region 28 below the the region 25 each have the same diameter, and on its opposite end the guide sleeve has a further region 29 of increased diameter, which is equivalent to the diameter of the region 25. In this region 29, the guide sleeve 22 has a longitudinal bore 30, the longitudinal bore 30 being located outside the diameter determined by the region 28. The guide sleeve 22 is cylindrical, and at its end adjacent to the frustoconical enlargement 23 it has a radially inwardly extending restriction with a step 31, the inside diameter of which is equivalent to the outside diameter of a piston 32. Thus this piston 32 fits in a sealed manner through the upper region of the guide sleeve 22, or in other words in the region of the restriction 31, and at the other end of the piston rod 32 a thickened portion 33 is provided, which can slide back and forth inside the guide sleeve, and when the piston rod 32 is fully extended comes to rest against the step 31, which limits the extension motion.

The guide sleeve 22 is encompassed by a sealing or support bushing 34, which rests with its upper end against the lower surface of the longitudinal frame part 12. The other end of the sealing bushing 34 has a chamfer 35, and a closure plug 36 is fitted on toward the free end in the vicinity of the chamfer 35, the plug being joined by a screw connection 37 to the lower face end of the guide sleeve 22. Via this screw connection 37 and the frustoconical enlargement 23, the longitudinal frame part 12, the guide sleeve 22, the support or sealing bushing 34 and the plug 36 are braced against one another.

The plug 36 has a cylindrical extension 38, that extends in a sealed manner into the interior of the guide sleeve 22; for this purpose, this protrusion 38 has a groove 39, in which a seal 40 is placed. Adjoining the protrusion 38, the plug 36 has a flanged rim 41, which with the interposition of a seal 42 is pressed against the end face of the support bushing. The flanged rim of the plug 36 then receives the screw connection 37.

On its end opposite the protrusion 38, the plug 36 has an indentation 43; projecting from the bottom of this indentation is a protrusion 44, and a longitudinal or central bore 45 extends through this protrusion 44 and through the protrusion-like region 38. Toward the free end of the protrusion 44, a plunger-type armature 46 of an electromagnetic valve 47 can come to rest, and in the vicinity of the transition between the flanged rim 41 and the protrusion-like region 38, there is a throughbore 48.

In the vicinity of the rest of the support bushing 44 on the longitudinal frame part 12 is a seal 49, and there is also a seal where the electromagnetic valve is pressed against the lower face of the plug 36.

The hydraulic fluid, which is preferably water, flows out of the chamber 50 in the interior of the longitudinal frame part 12 via the groove 26 into the chamber 51 between the support bushing 34 and the guide sleeve 22 and via the bore 30 into the chamber, 52, between the lower end face of the guide sleeve 22 and the plug 36. The fluid flows through the bore 48 into the vicinity of the indentation 43 and via the longitudinal bore 45 into the chamber 53 below the piston, raising the piston or piston rod 32 upward in the direction of the arrow A as long as the valve 46/47 is opened.

The embodiment illustrated in of FIG. 3 is substantially identical to the version of FIG. 2, so that it need not be described in further detail here. The only difference is that a mushroom head 60 is provided on the upper end of the piston rod 32 and a mat 61 is supported on the mushroom head. Instead of the mat 61, the possibility also exists of introducing the mushroom head, or piston rod 32 with the mushroom head, into the interior of a waterbed, with two mats 61 and 62 (the latter indicated by dashed lines) are provided, and the space between the two mats 61 and 62 is sealed off and filled with water.

As suggested by dashed lines in FIG. 1, a hose 70 of elastic material may be provided in the interior of the longitudinal frame part 12, and with the hose the volume of the fluid to be introduced into the longitudinal frame part 12 can be varied. In that case the hose 70 is a kind of spring, and in this way the lowering of the piston/cylinder mechanisms in the region B, for instance, where a person's buttocks, for instance, are located can be varied.

With the embodiment according to FIG. 1, the possibility exists of adjusting the individual slats 14 and 15 as needed, and if necessary, the slats 14 and 15 may be embodied as shown in FIG. 3, in that case attaining and producing a massage bed.

The following features are also important:

It has been found that the load on the slats on which the body rests is variable, depending on which part of the body is resting there. Therefore, those slats that are located in the vicinity of the buttocks, for instance, are loaded more heavily than the others. To make the load more uniform, every slat or every other slat in the vicinity in which the buttocks are located is supported on the piston/cylinder mechanisms, while contrarily only every other slat or every third slat is supported in the regions that are not so heavily loaded. These may be the region of the head and the legs.

The guidance of the unsupported slats relative to one another is effected by means of the tension wire or the articulated rails 68.

I claim:

1. A bed, comprising a box-like frame having longitudinal frame parts and transverse frame parts joined to said longitudinal frame parts, slats with ends for supporting a mattress, piston/cylinder mechanisms supporting said ends of said slats on said longitudinal frame parts in the vicinity of said longitudinal frame parts, each of said piston/cylinder mechanisms including fluidically operative chambers communicating with one another hydraulically or pneumatically for adjusting the slats to various heights depending on the respective partial weight of a person resting thereon, said longitudinal frame parts being hollow for hydraulically or pneumatically connecting said operative chambers of said piston/cylinder mechanisms.

2. The bed according to claim 1, wherein said piston/cylinder mechanisms include electromagnetically actuatable valves for controlling the communication between said longitudinal frame parts and said operative chambers of said piston/cylinder mechanisms.

3. The bed according to claim 2, wherein said piston/cylinder mechanisms further include a guide sleeve for guiding said piston rods in a vertical direction, a support bushing and a closure plug with an outside face screwed to said guide sleeve, said electromagnetic valve being secured to said outside face of said closure plug.

4. The bed according to claim 3, including a first chamber on the inside of said longitudinal frame parts, a second chamber between said guide sleeve and said support bushing, a third chamber between said electromagnetic valve and said plug, a fourth chamber below said piston rod being said operative chamber, a through bore in said guide sleeve for allowing communication between said second and third chambers, and bores in said plug for allowing communication between said second and fourth chambers via said third chamber, said first and fourth chambers communication with one another via said second and third chambers, said through bore and said bores.

5. A bed, comprising a box-like frame having longitudinal frame parts and transverse frame parts joined to said longitudinal frame parts, slats with ends for supporting a mattress, piston/cylinder mechanisms supporting said ends of said slats on said longitudinal frame parts in the vicinity of said longitudinal frame parts, each of said piston/cylinder mechanisms including fluidically operative chambers communicating with one another hydraulically or pneumatically for adjusting the slats to various heights depending on the respective partial weight of a person resting thereon, said slats having an upper surface and a hollow interior, and a further piston/cylinder mechanism with a piston rod and a cylinder associated with said slats, said piston rod protruding from said upper surface of said slats and said mechanisms including means for controlling and actuating said pistons.

6. The bed according to claim 5, wherein said means include electromagnetic valves.

7. The bed according to claim 5, wherein said slats each have a lower surface and wherein said further piston/cylinder mechanism includes a guide sleeve extending through said slats, a piston rod being movable in a longitudinal direction of said guide sleeve, a support bushing surrounding said guide sleeve and protruding beyond said guide sleeve, said support bushing resting against said lower surface of said slat, a closure plug being screwed to said guide sleeve and pressing said support bushing against said slat.

8. A bed, comprising a box-like frame having longitudinal frame parts and transverse frame parts joined to said longitudinal frame parts, slats with ends for supporting a mattress, piston/cylinder mechanisms supporting said ends of said slats on said longitudinal frame parts in the vicinity of said longitudinal frame parts, each of said piston/cylinder mechanisms including fluidically operative chambers communicating with one another hydraulically or pneumatically for adjusting the slats to various heights depending on the respective partial weight of a person resting thereon, said longitudinal frame parts each having a lower surface and each of said piston/cylinder meachanisms including a guide sleeve extending through said longitudinal frame parts, a piston rod being movable in a longitudinal direction of said guide sleeve, a support bushing surrounding said guide sleeve and protruding beyond said guide sleeve, said support bushing resting against said lower surface of said longitudinal frame part, a closure plug screwed to said guide sleeve and pressing said support bushing against said longitudinal frame part.

9. A bed, comprising a box-like frame having longitudinal frame parts and transverse frame parts joined to said longitudinal frame parts, slats with ends for supporting a mattress, piston/cylinder mechanisms supporting said ends of said slats on said longitudinal frame parts in the vicinity of said longitudinal frame parts, each of said piston/cylinder mechanisms including fluidically operative chambers communicating with one another hydraulically or pneumatically for adjusting the slats to various heights depending on the respective partial weight of a person resting thereon, said longitudinal frame parts defining an interior chamber, including air-filled hoses of elastic material disposed in said interior chamber.

10. A bed, comprising a box-like frame having longitudinal frame parts and transverse frame parts joined to said longitudinal frame parts, slats with ends for supporting a mattress, piston/cylinder mechanisms supporting said ends of said slats on said longitudinal frame parts in the vicinity of said longitudinal frame parts, each of said piston/cylinder mechanisms including fluidically operative chambers communicating with one another hydraulically or pneumatically for adjusting the slats to various heights depending on the respective partial weight of a person resting thereon, and an articulate rail attached to and disposed below said ends of said slats.

* * * * *